United States Patent [19]

Smith et al.

[11] 4,251,273

[45] Feb. 17, 1981

[54] METHOD OF FORMING VALVE LIFTERS

[76] Inventors: David T. Smith, 2619 W. Pratt Ave., Chicago, Ill. 60645; Harold R. Biehl, 10 Edward Ave., Lehigh Acres, Fla. 33936

[21] Appl. No.: 17,021

[22] Filed: Mar. 2, 1979

[51] Int. Cl.[3] ..... B22F 5/00

[52] U.S. Cl. ..... 75/200; 75/123 K; 75/123 J; 75/123 N; 75/214; 148/126

[58] Field of Search ..... 75/200, 214, 123 K, 75/123 J, 123 N; 148/126

[56] References Cited

U.S. PATENT DOCUMENTS

| | | | |
|---|---|---|---|
| 2,670,281 | 2/1954 | Hutchison | 75/123 K |
| 2,861,908 | 11/1958 | Mickelson et al. | 75/123 K |
| 3,060,560 | 10/1962 | Biehl et al. | 428/602 |
| 3,110,586 | 11/1963 | Gulya et al. | 75/123 K |

*Primary Examiner*—Brooks H. Hunt

*Attorney, Agent, or Firm*—Hill, Van Santen, Steadman, Chiara & Simpson

[57] ABSTRACT

This invention relates to a method of making a valve lifter or the like wherein elemental iron powder is blended with smaller sized powders of manganese, molybdenum, and nickel, or sources of these metals, the resulting mixture is pressed into a coherent preform which is then sintered to cause solid state diffusion and alloying to occur within the preform. The sintered preform is then pressed into a shape which approaches the theoretical density of the metal and has a nearly uniform density carburized and heat treated, the pressing being carried out at ambient temperatures to produce a valve lifter or similar article having superior wearing properties at a lower cost, when compared with present materials and methods of manufacture.

9 Claims, 5 Drawing Figures

METHOD OF FORMING VALVE LIFTERS

BACKGROUND OF THE INVENTION

1. Field of the Invention

This invention is in the field of powder metallurgy and involves a combination of steps including pressing a powder mixture, sintering the resulting preform to cause alloying and solid state diffusion and then forming the preform into the required shape at substantially theoretical density by means of backward extrusion. This extrusion may and preferably is followed by a carburizing treatment and a series of reheating steps with intermediate quenching to achieve the hardness desired in the finished product.

2. Description of the Prior Art

Valve lifters used today are usually composed of cast iron, cast iron alloys, composites, or other expensive ferroalloy materials. Significant improvements in the art of forming high density parts by means of cold extrusion of ferrous metal powder are described in our previous U.S. Pat. No. 3,060,560. The disclosure of that patent in its entirety is incorporated herein by reference.

U.S. Pat. No. 3,150,444 describes a method of producing a heat hardenable steel for use in high speed tools which involves compressing atomized pre-alloyed powder of the steel, sintering the compacted powder in the presence of a reducing atmosphere, and mechanically working the compacted and sintered powder so as to achieve a density approaching the theoretical density of the metal.

U.S. Pat. No. 3,198,182 is directed specifically to the manufacture of valve lifters. In this patent, there is described a procedure wherein an intimate mixture of powdered carbon, tungsten, molybdenum, silicon, and iron is compressed to form a thin briquette. This briquette is placed in a shallow cavity formed in the working end of a valve lifter and the briquette and adjacent valve lifter surfaces are joined together by a heating at a temperature of about 2200° F. thereby creating a diffusion bond with the remainder of the valve lifter. This patent is typical of attempts to provide bimetallic surfaces of a harder composition on the working end of a valve lifter.

In U.S. Pat. No. 3,200,801 there is described a valve lifter having a two-piece body in which the major portion is formed of a stainless steel tubular member, and a minor portion is formed of a low alloy steel tubular member. The low alloy steel portion is interposed between the stainless steel portion and an alloy cast iron foot piece of the valve lifter.

U.S. Pat. No. 3,244,506 describes a powder metallurgy method utilizing a pre-alloyed atomized metal powder wherein the powder is formed into a metal cutting tool and the metal is reacted to form finely dispersed carbides in a fine grain metal matrix.

Robinson et al U.S. Pat. No. 3,255,513 is similar to the aforementioned U.S. Pat. No. 3,198,182 but is directed specifically to using a briquette composed of a powdered metal mixture of substantial amounts of carbon, molybdenum, tungsten, silicon, and iron.

In U.S. Pat. No. 3,655,365 there are described compositions for use as tools, formed by the hot consolidation of pre-alloyed powders having a uniformly dispersed carbide phase of a grain size less than 3 microns. The alloy contains from 10 to 40% of tungsten or molybdenum, from 0.5 to 4% carbon, a carbide former, and a mixture of iron and cobalt as the balance.

In U.S. Pat. No. 3,657,800 there is described a valve lifter employing a wear plate of graphitic alloy steel which is friction welded to a steel tube in an attempt to improve the scuff resistance at the point of contact with the camshaft.

A hydraulic tappet having a barrel formed of powdered metal which is sintered and compacted, and employing a cam face of a sintered component infiltrated with a hardening agent is described in U.S. Pat. No. 3,683,876. Optionally, the cam face may be a separate sintered metal disc suitably attached to the tappet barrel.

In U.S. Pat. No. 3,690,959 there is described a tappet made of a high carbon, high chromium alloy. The alloy is cast, cooled quickly to form a relatively small number of relatively large primary chromium carbide particles dispersed in a matrix of austenite containing a solid solution of chromium and carbon. Large numbers of relatively small particles of chromium carbides are then precipitated on the matrix and distributed throughout the spaces between the large primary carbon particles. The casting is hardened by heating and subsequent quenching to convert the matrix to martensite without changing the carbide particles.

The problem of reducing oxide inclusions which is important in this technology is referred to in U.S. Pat. No. 3,740,215. That patent describes a method of consolidating powder composed of metallic particles into a porous body, substantially sealing the surface of the body by closing the surface pores, heating the body, and then hot working it.

U.S. Pat. No. 3,832,763 refers to the problem of densifying sintered workpieces by drop-forging them in a die resulting in a massive deformation in the drop-forging step.

U.S. Pat. No. 3,867,751 is directed specifically to the manufacture of inner and outer bearing rings but also addresses itself to the problem of densifying sintered powdered metal blanks. In this patent, there is disclosed a method wherein the sintered powdered metal blank having a density of at least 96% is roll formed to the shape of the inner or outer bearing ring.

Powdered metal parts having bearing surfaces are described in U.S. Pat. No. 3,874,049. The method involved in that patent consists in cold forming a sintered preform through the application of shear forces to the surface of the preform where the bearing surface is desired, by causing a movable die to penetrate and wipe along such surface of the preform.

Powder metallurgy forging is described in U.S. Pat. No. 3,897,618. In this patent, steel powder is forged at a temperature at which the steel is characterized by a microstructure containing specified percentages of ferrite and austenite.

In U.S. Pat. No. 3,992,763 there is described a method of making powdered metal parts wherein a briquetted powder metal preform is carburized by means of a gas atmosphere and then hot forged to produce a highly densified, carburized powdered metal part.

In U.S. Pat. No. 4,051,590 there is described an automated method of hot forging articles from powder metal preforms. The preforms are passed through an induction heating device in which they are heated to a forging temperature. The heated preforms are then forged into finished articles, after which they are cooled.

Surface densification of a powdered metal part is the subject of U.S. Pat. No. 4,059,879. The method involved in this patent applies densifying pressure to a selected portion of a sintered powdered metal element while applying restraining pressures to other portions of the element in order to inhibit growth and cracking of the element during the cold deformation which occurs.

Finally, U.S. Pat. No. 4,086,087 describes a method for producing powdered metal parts wherein shaped powdered metal preforms are treated with an impregnant which is immiscible with organic lubricants, the metal part is treated with a lubricant, an then sized or coined. The sized powdered metal part is preferably also heat treated.

SUMMARY OF THE INVENTION

The present invention represents an improvement in our prior U.S. Pat. No. 3,060,560.

Through the use of semi-production tooling we have discovered that our former dimensional parameters of length to diameter ratio and length to wall thickness ratio of sintered metal articles can now be increased to facilitate the production of longer wearing and less costly one piece powdered metal valve lifters for internal combustion engines.

This one piece powdered alloyed steel metal valve lifter is formed to its final cup-like shape at ambient temperatures and is at substantially theoretical full density, nearly free of inclusion content, free of residual porosity, having minimal segregation, and nearly uniform dense structure and composition, carburized, austenitized, quenched and tempered to a desired hardness.

The significant increase of wear properties ascertained is attributable to the near perfect material condition of minimal inclusion content and residual porosity as compared with most commercial cast, wrought and hot forged powdered metals.

The lessening of inclusions and porosity together with nearly full density, minimal alloying content, carburizing and heat treating results in improving the mechanical properties of our powdered metal valve lifter to the extent of withstanding the extremely high contact stresses developed between the valve lifter face and its respective cam face located on the camshaft proper.

The method of the present invention involves generally blending elemental iron powder of a given particle size with smaller sized powders providing sources of manganese, molybdenum, and nickel. The resulting mixture is pressed into a coherent preform and then sintered to cause solid state diffusion and alloying to occur within the preform. The preform is then pressed to its final cup-like shape in which it is at substantially theoretical full density, nearly free of inclusion content, free of residual porosity, having minimal segregation and nearly uniform dense structure and composition. The pressing is carried out by means of the type of backward extrusion which is described in our aforementioned patent. In the most preferred form of the present invention, the pressing is followed by a carburizing treatment which, in turn, is followed by a heat treatment to achieve a predetermined hardness value.

The initial mixture of powders contains from about 0.75 to 1.50% manganese, from about 0.65 to about 1.25% molybdenum, from about 0.50 to 1.0% nickel, with the balance being essentially iron powder with the usual impurities. The preferred composition contains from 0.80 to 1.25% manganese, from 0.80 to 1.0% molybdenum, from 0.55 to 0.75% nickel, and the balance essentially iron. The iron powder particles are larger than the particles of alloying metal powders themselves being of −100 mesh size. The alloying metal powders have extremely small mesh sizes being on the order of −200 to 325 mesh or smaller whereby the smaller alloying metal powders cover the relatively larger sized iron powder particles even with the small quantities used.

Since the achievement of improved dimensional parameters and densification in our previous patent we have made semiproduction tooling to further increase those parameters to the extent where the length to diameter ratio is in the order of 2.5 to 1 which is substantially higher than now considered technically feasible.

Furthermore, we can produce cup-like shapes which have a length to wall thickness ratio of at least 25 to 1 and preferably from 26 to 30 to 1 which again is substantially higher than now considered technically feasible.

This ability makes it possible to design improved performance valve lifting mechanisms with respect to lower weight, resulting in .less reciprocating weight which, in turn, diminishes engine unbalance and reverberation possibilities.

BRIEF DESCRIPTION OF THE DRAWINGS

A further description of the present invention will be in conjunction with the attached drawings which illustrate a preferred embodiment thereof.

DESCRIPTION OF THE PREFERRED EMBODIMENTS

Figure 1:
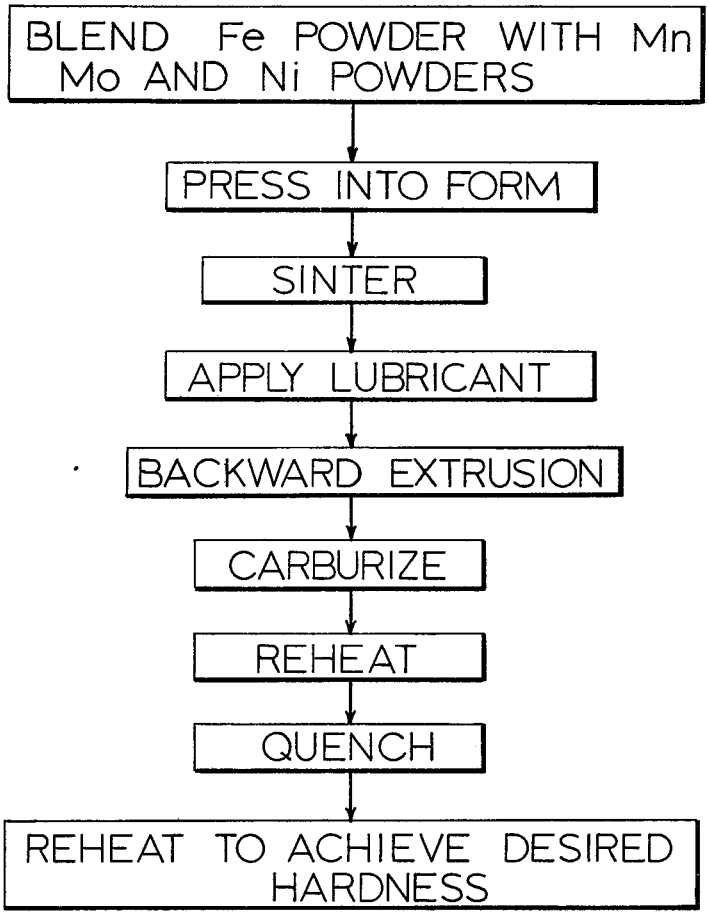
FIG. 1 is a flow chart designating the steps involved in the overall manufacturing process.

As indicated in FIG. 1, the first step of the process is a thorough mixing of the iron powder with manganese, molybdenum, and nickel powders of smaller particle size. A typical mixture might contain iron particles of −100 mesh size and having an analysis of 98% Fe, particles of molybdenum of a −200 mesh size analyzing 99.9% Mo, particles of manganese or manganese source, and particles of nickel of −325 mesh size analyzing a minimum of 98% Ni. Each of these materials may contain small amounts of commonly occurring impurities whether metallic or non-metallic. The mixing achieves a complete and uniform powder blend. The smaller mesh alloying elements intimately cover the relatively larger sized iron particles even in small quantities. If the elemental alloying powders are not available, it is possible to substitute master alloys of ferro-nickel, ferro-manganese and ferro-molybdenum.

The addition of the alloying elements in the present invention, even in relatively small quantities, together with nearly uniform and full densification, permits normal carburizing and heat treating resulting in achieving high hardness, superior wear and strength properties. These properties equal or surpass other powder metal structural parts produced by multiple pressing and hot forging and far exceed like properties of heat treated commercial cast and wrought metals of similar alloy content.

The preferred compositions used in making the powdered metal compacts of the present invention are those which contain 0.75 to 1.50% manganese, 0.65 to 1.25% molybdenum, and 0.50 to 1.0% nickel, with iron being substantially the balance. The particularly preferred compositions contain 0.80 to 1.25% manganese, 0.80 to 1.0% molybdenum, and 0.55 to 0.75% nickel, with iron again being the balance.

Figure 2:
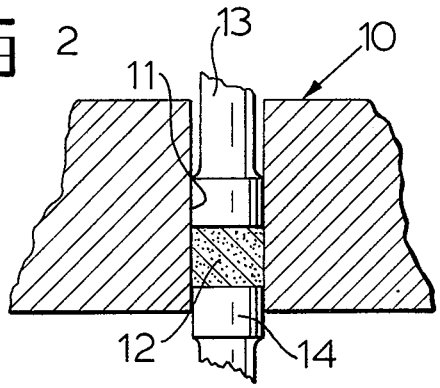
FIG. 2 is a fragmentary cross-sectional view illustrating the manner in which the powdered metal mixture is initially compacted into a preform.

After thorough blending, the mixture of iron and alloying metals is then ready for the step of initial compaction to form a preform. This procedure is schematically illustrated in FIG. 2 of the drawings which illustrates a compacting die 10 having a die cavity 11 in which a powdered mixture 12 of iron, manganese, molybdenum, and nickel is introduced. Approximately 1% by weight of zinc stearate or a blend of modified fatty acid ester lubricants is added to the metal powder mix to reduce the friction existing during powder compaction and to aid in furnishing lubricity when the compact is ejected. The apparent density of the powder mix is approximately 2.5 to 2.6 grams per cubic centimeter initially and the preform may have a density on the order of 6.2 grams cubic centimeter.

After compaction, the cohesive preform is sintered which may be performed in a 3 zone, mesh belt, gas fired, furnace having an endothermic gas supplied throughout each zone with a dew point of 28° F. to 34° F. in each zone creating a reducing atmosphere in order to prevent oxidation and reduce the oxides of the powders. The first zone may operate at a range of about 1500° to 1525° F. with the reducing atmosphere to volatilize the lubricant used in the compacting operation and therefore assisting the sintering operation which takes place in the second zone. In the second zone, the compact is heated to a temperature of about 2050° F. for a minimum of 30 minutes and this temperature, together with the reducing atmosphere, serves to coalesce the compact and causes alloying of the powder mix by virtue of the migration of the powders due to solid state diffusion into each other into a homogeneous structure.

The third zone serves to cool the compact to room temperature at a slow rate, usually taking about 15 minutes before the compact leaves the furnace, thereby preventing oxidation.

The next step after sintering involves the application of a lubricant to the surface of the sintered alloyed preform using materials such as zinc phosphate which reacts with the iron surface to etch the surface slightly and deposit a thin film of barrier material which acts as a stop-off to inhibit the metal of the preform from cold welding to the punch during the succeeding operations. A fatty acid ester may be coated onto the surface of the phosphated iron preform to form zinc stearate which, in turn, acts as an extreme pressure lubricant to aid in the succeeding combination operation of extruding, densifying, and shaping to final size.

Figure 3:
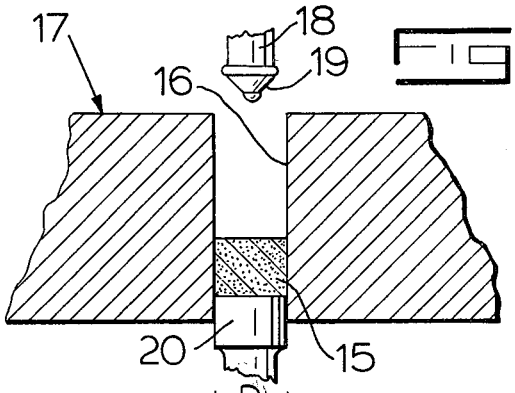
FIG. 3 is a fragmentary cross-sectional view showing the preform in an extrusion die just prior to being struck with an extrusion punch.
Figure 4:
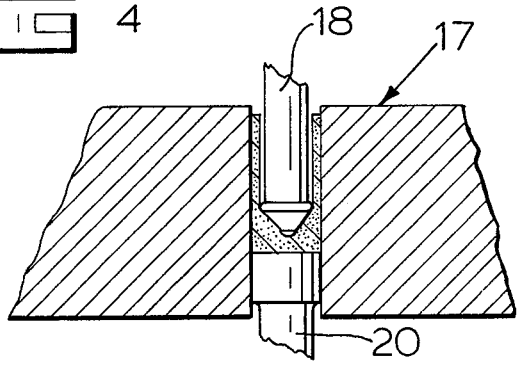
FIG. 4 is a view similar to FIG. 3 but showing the extrusion punch at the limit of its downward travel.
Figure 5:
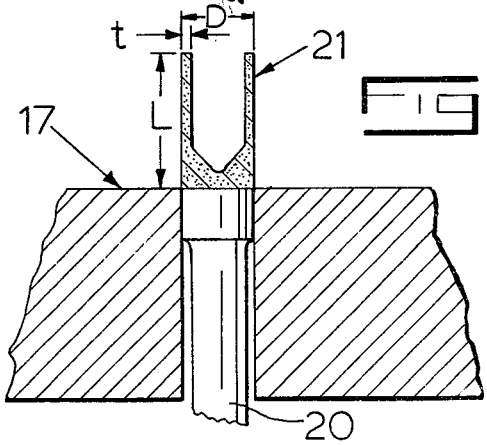
FIG. 5 is a view similar to FIGS. 3 and 4, but showing the extrusion punch withdrawn, and the valve lifter body blank in the process of being ejected from the extrusion die.

The succeeding steps of the process are illustrated in FIGS. 3 to 5, inclusive, in the drawings. The next step is to insert the lubricated, sintered preform 15 into a cavity 16 of an extrusion die 17 which is located on the bolster of a mechanical or hydraulic acting press (not shown). The extrusion die 17 is used in conjunction with an extrusion punch 18 having a spherically-shaped protrusion 19. The particular assembly shown in FIGS. 3 to 5 is intended for the shaping of a valve lifter of the solid type. When a hydraulic valve lifter is desired, the extrusion punch 18 merely has a rounded end portion instead of the protrusion 19. During the downward motion of the punch 18, as illustrated in FIG. 4, the pressure exerted by the punch forces the sintered compact to flow rearwardly in the type of backward extrusion process described in our aforementioned prior patent. This backward extrusion is carried out at ambient room temperature. The extreme pressures involved being on the order of 100 tons per square inch simultaneously shape and densify the preform to a nearly uniform density ranging from 97 to 99% or more of the theoretical density of the metal composition used. The nearly fully dense valve lifter microstructure has, as a result, all the necessary properties to be carburized and heat treated to achieve physical and mechanical properties previously achieved only in forged and/or wrought steel structures produced by highly refined processes such as vacuum melting and degassing. Upon upward movement of the punch 18, an ejector punch 20 pushes the densified compact 21 out of the cavity 16 as best illustrated in FIG. 5 of the drawings.

The succeeding heat treating procedures are variable, but preferably consist of a six-step operation. In the first, the valve lifter is heated to 1750° F. in a sealed container containing a carburizing compound for 8 hours or so to produce a carburized layer of about 0.040 inches in thickness below the surfaces of the valve lifter. The carbon content of the carburized layer is in the range of about 0.65 to 0.75% at the base of the 0.040" level to about 1.10 to 1.20% at the surface. Then, the carburized valve lifter is cooled to and held at a temperature of about 1550° F. for one hour. Finally, the carburized valve lifter is cooled in the container to room temperature.

The next step consists in reheating the valve lifter to 1650° F. and holding it at that temperature for about 10 minutes. From this temperature, it is quenched in oil at a temperature of 120° to 130° F. The carburized material is then reheated immediately after quenching to about 350° F. for one hour. The resulting case structure has an overall hardness of Rockwell 15N-88 minimum. The microstructure has a fine uniform grain martensite case with less than 5% retained austenite, substantially free of inclusion content, residual porosity, and segregation. The powdered metal valve lifter after heat treating can then be finish ground to the exact size and surface finish requirements with minimal metal removal.

One of the advantages of the valve lifter produced according to the present invention is that it gives the designer a wider latitude in which to design. When the present invention is used to produce a hydraulic valve lifter, a thinner wall body can be produced which permits a larger diameter plunger to be utilized which, in turn, results in a valve lifter having higher load carrying capacity. With a larger diameter plunger, the increased face area provides higher lifter pressure with the same unit line pressure from the engine oil pump. In addition, the larger diameter plunger has a larger body area which, in turn, wears less than a smaller diameter plunger. Moreover, because of the larger diameter plunger, the ratio of the diameter to the length of the stroke will be substantially decreased. The resulting effect is the lessening of the severity and frequency of sticking of the plunger in the valve lifter body which, in turn, causes poor combustion conditions and above normal engine noise.

When the present invention is used to manufacture solid valve lifters, which have a metal to metal operating mode, higher wear resistance, greater load carrying capacity, and increased anti-scuffing properties are experienced over the presently used cast iron valve lifters. Secondly, the pressing or extrusion process used to densify and shape the solid valve lifter permits a lesser thickness in the sidewall of the valve lifter as compared to a cast iron or other sintered metal valve lifters. This sidewall thickness has been identified at reference character "t" in FIG. 5. Because of the thinner wall thickness, the weight of the valve lifter of the present invention is less than presently used valve lifters, resulting in less reciprocating weight which, in turn, diminishes engine unbalance and reverberation possibilities.

Referring again to FIG. 5, the dimension L has been used to identify the overall length of the valve lifter. In the present invention, the ratio of length to wall thickness can be considerably higher than in prior art devices, including those described in our previous patent. For example, the length to wall thickness ratio ("L"/"t") can be at least 25 to 1 and is typically in the range of 26 to 30 to 1. Moreover, the ratio of the length "L" to the overall diameter "D" of the valve lifter ("L"/"D") can also be quite high, being on the order of at least 2.5 to 1.

The effect of molybdenum in the powder compact is largely dependent on its contribution to hardenability. A small amount of molybdenum produces a large increase in hardenability. Furthermore, molybdenum is not easily oxidized particularly at sintering temperatures of 2050° F., where it goes into solid state solution with iron, resulting in the creation of complex carbides $Fe_3Mo_3C$ when carburized and subsequently heat treated. The addition of molybdenum also serves to narrow the range of hardness throughout the total thickness, thereby insuring a core strength which can support a high hardness case.

The use of nickel in the compact is based largely on the high degree of solubility in iron during the sintering operation. This phenomenon aids in the interdiffusion of the manganese and molybdenum powders with iron. Because of nickel's solubility in iron at sintering temperatures, it not only promotes the interdiffusion of itself with iron and with molybdenum and manganese, but also aids in the self-diffusion of iron. The small amount of nickel added effectively increases all the mechanical properties beyond that of wrought steels of similar alloy content, or straight carbon heat-treatable steels because of the high density achieved.

Manganese is used in the powder because of its effect of lowering the activity efficiency of carbon during the carburizing operation. This tendency promotes higher carbon content at the surface of the material rather than the carbon passing easily into the subsurface where it is not required or desired. Manganese also adds significantly to the mechanical properties of the material in the quenched and tempered condition. The addition of amounts on the order of 1% of manganese assures the formation of manganese carbide along with iron carbides. Still further, the addition of manganese permits lowering the carbon content without reducing the potential tensile strength, and further increases ductility.

At the present time, most fabricators of powdered metal structural parts claiming full density and high strength are using high cost, pre-alloyed powders and forging at relatively high temperatures of 1600° to 2100° F. Not only are the pre-alloyed powders approximately 30% higher in cost than the elemental powders, but the forging furnace costs further increase the cost of the parts proportional to their weight and size.

It should be evident that various modifications can be made to the described embodiments without departing from the scope of the present invention.

We claim as our invention:

1. The method of making a valve lifter or the like which comprises:

blending elemental iron powder of −100 mesh size with smaller size powder particles of sources of manganese, molybdenum and nickel, pressing the resulting mixture into a coherent preform, sintering said preform to cause solid state diffusion and alloying within said preform, and pressing the sintered preform to an elongated shape having a large length to wall thickness ratio, said shape having substantially theoretical, uniform density at ambient temperatures.

2. The method of claim 1 in which said last-named pressing is carried out by backward extrusion.

3. The method of claim 1 in which the last-named pressing is followed by a carburizing treatment.

4. The method of claim 3 in which said carburizing treatment is followed by a heat treatment to achieve a predetermined hardness value.

5. The method of claim 1 in which said resulting mixture contains:

from 0.75 to 1.50% manganese;
from 0.65 to 1.25% molybdenum;
from 0.50 to 1.0% nickel;
and the balance essentially iron.

6. The method of claim 1 in which said resulting mixture contains:

from 0.80 to 1.25% manganese;
from 0.80 to 1.0% molybdenum;
from 0.55 to 0.75% nickel;
and the balance essentially iron.

7. The method of claim 1 in which said shape has a length to diameter ratio of at least 2.5 to 1.

8. The method of claim 1 in which said shape has a length to wall thickness ratio of at least 25 to 1.

9. The method of claim 1 in which said shape has a length to wall thickness ratio of from 26 to 30 to 1.

* * * * *